United States Patent [19]

Grollimund et al.

[11] 4,330,356

[45] May 18, 1982

[54] WEB MARKING APPARATUS AND METHOD

[75] Inventors: Everett C. Grollimund, Midlothian; Steven F. Spiers, Richmond, both of Va.

[73] Assignee: Philip Morris, Incorporated, New York, N.Y.

[21] Appl. No.: 160,581

[22] Filed: Jun. 18, 1980

[51] Int. Cl.[3] ..... B65H 81/00

[52] U.S. Cl. ..... 156/446; 156/552

[58] Field of Search ..... 156/552, 519–520, 156/185, 446, 571, 378, 64, 450, 457–458; 242/67.1 R, 54 R, 55 R

[56] References Cited

U.S. PATENT DOCUMENTS

| | | | |
|---|---|---|---|
| 2,119,863 | 6/1938 | Van Kempen | 156/520 X |
| 2,325,578 | 7/1943 | Booty | 156/571 X |
| 2,351,404 | 6/1944 | Colley | 156/552 X |
| 3,783,059 | 1/1974 | Black et al. | 156/64 |

FOREIGN PATENT DOCUMENTS

| | | | |
|---|---|---|---|
| 41-7022975 | 8/1966 | Japan | 156/552 |

*Primary Examiner*—David A. Simmons

[57] ABSTRACT

An apparatus and method for marking a web at a selected location along its length. A coil is rotated on its axis to wind the web thereon and draw the web into the coil along a predetermined path. A flat marker is fed between the incoming portion of the web and the coil codirectionally with movement of the incoming portion so that a surface of the marker confronts and engages a surface of the web. Preferably, a marker having an adhesive face is fed so that such adhesive side engages the incoming portion of the web.

4 Claims, 2 Drawing Figures

WEB MARKING APPARATUS AND METHOD

BACKGROUND OF THE INVENTION

The present invention relates to web handling and processing, and more particularly relates to an apparatus and method for marking a web at a selected location along its length as the web is being coiled or wound on a core member.

In numerous industrial applications, sheet like materials such as paper, film, foil and the like are handled in the form of semi-continuous webs, which are often stored in coil form. It is sometimes desirable to mark such a web at one or more locations along its length.

For example, cigarette tipping paper is often handled in semi-continuous web form. In one process, a coil containing a web of tipping paper may be mounted on the payout stand of a paper perforating machine, and the leading end of the web may be threaded through the machine, past the perforating apparatus of the machine to a takeup coil mounted on the takeup stand of the machine. The perforating apparatus is then started and the paper is fed past it by unwinding the paper from the supply coil and winding it onto the takeup coil. However, those portions of the web which were originally leading and which were threaded downstream of the perforating apparatus before it was started will not be perforated. It is desirable to mark the web at a location corresponding to the point of demarcation between perforated and unperforated portions of the web so that such point of demarcation can be detected during subsequent processing operations to prevent feeding of unperforated tipping paper to the cigarette making operation.

BRIEF SUMMARY OF THE INVENTION

It is an object of the present invention to provide a method and an apparatus for marking a web at a selected location along its length.

It is a further object of the present invention to provide such apparatus in a form which can be utilized to mark a web while the web is being wound onto a takeup coil during a processing operation.

It is yet another object of the present invention to provide such apparatus in a form which is simple and rugged.

The apparatus of the present invention includes takeup means for supporting a coil and rotating the coil about its axis to draw a web onto the coil along a predetermined path. The apparatus also includes selectively operable marker dispensing means for feeding a flat marker into the space between the incoming portion of the web and the coil immediately upstream of the lap line between the incoming portion and the coil so that a surface of the marker will confront a surface of the web and such mutually confronting surfaces will be engaged with one another.

Because the apparatus of the present invention feeds the marker into the space immediately upstream of the lap line between the incoming portion of the web and the coil, the marker will be carried past the lap line by movement of the web immediately after the marker engages the web. As soon as the marker is carried past the lap line, it is held between the outermost turn of the coil and the next adjacent turn. Thus, the marker becomes securely emplaced in the coil immediately after its engagement with the web, and there is little chance of the marker being accidentally disengaged from the web.

Preferably, the marker dispensing means are arranged so that the marker will be engaged with the coil facing surface of the incoming portion of the web, rather than with the previously coiled portion of the web, and the marker dispensing means preferably includes means for holding a marker which has an adhesive face so that the adhesive face of the marker will confront the coil facing surface of the incoming web portion. When this arrangement is utilized, the adhesive surface of the marker will secure the marker to the web until the marker is carried past the lap line and trapped between the turns of the coil.

The method of the present invention includes the steps of winding a web onto a coil along a predetermined path and feeding a flat marker into the space between the incoming portion of the web and the coil immediately upstream of the lap line between the incoming portion and the coil so that a surface of the marker will confront a surface of the web and the marker will engage the web. The method of the present invention has advantages corresponding to the advantages of the apparatus described above.

DETAILED DESCRIPTION OF THE PREFERRED EMBODIMENTS

As used herein, the term "downstream" refers to the direction of movement of the linearly-extensive portions of the web along its course of travel. The term "upstream" refers to the direction opposite to the downstream direction. The terms "lateral" and "laterally" refer to directions transverse to the travel course of the web.

Figure 1:
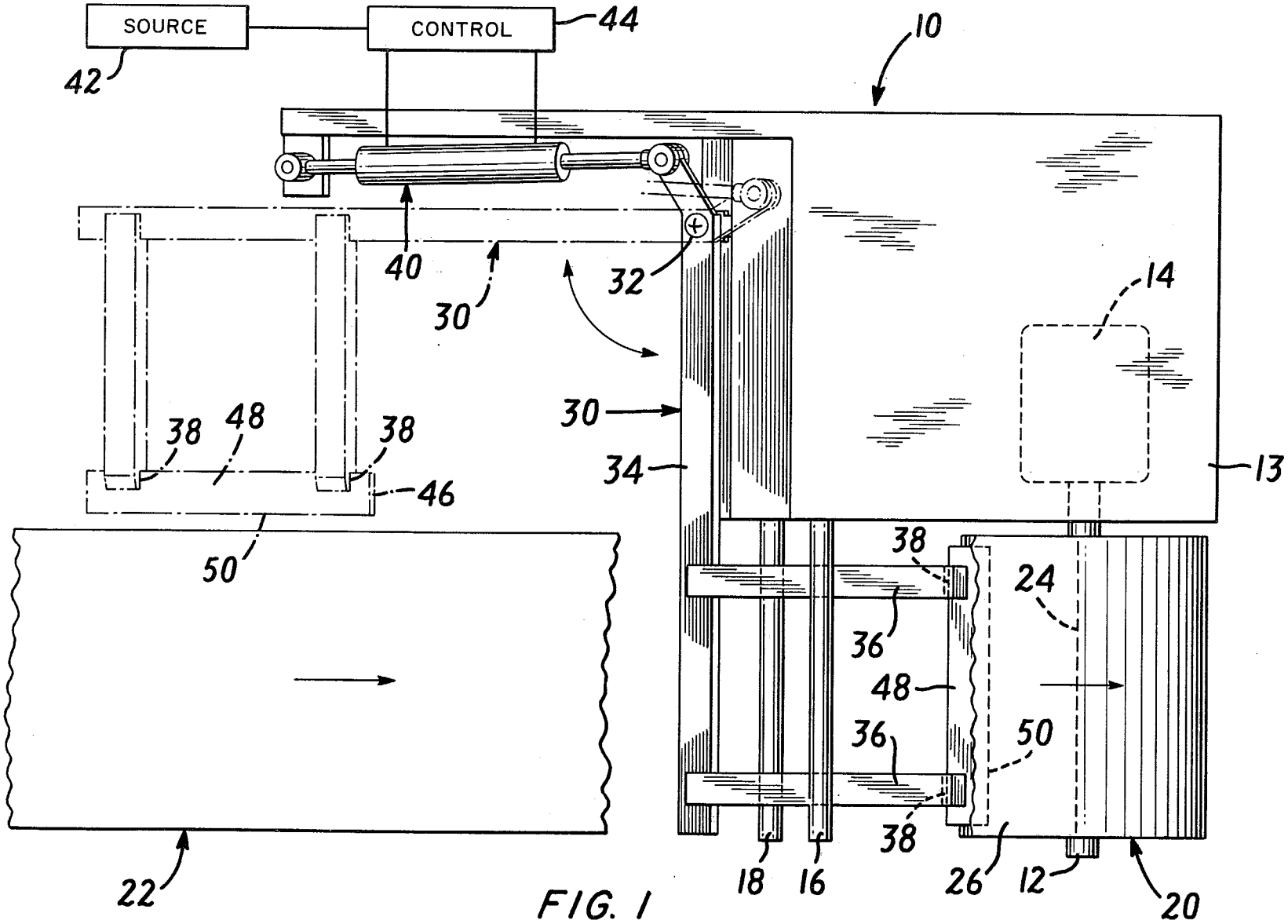
FIG. 1 is a schematic top plan view of apparatus according to a preferred embodiment of the present invention in which a portion of the web being marked has been removed for clarity of illustration.
Figure 2:
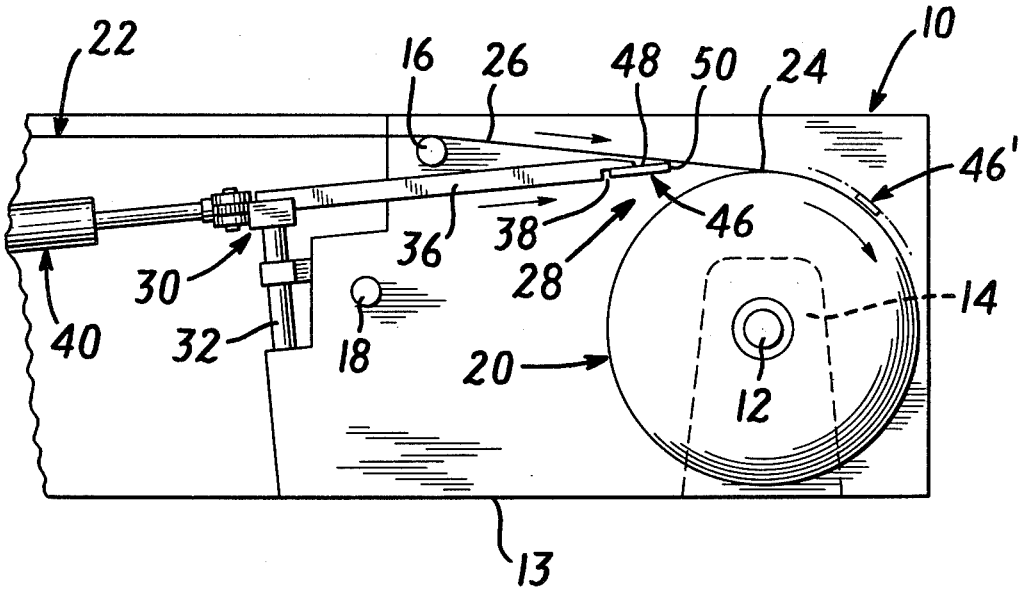
FIG. 2 is a schematic fragmentary side elevational view of the apparatus depicted in FIG. 1.

As seen in FIGS. 1 and 2, apparatus according to a preferred embodiment of the present invention includes a frame 10 and a takeup coil support shaft 12 rotatably mounted to the frame. A motor 14 mounted within the frame drives the takeup coil support shaft 12. A pair of web support rollers 16 and 18 are rotatably mounted to the frame 10 so that they extend parallel to the takeup coil support shaft 12. The motor 14 can rotate the shaft 12 in the clockwise direction as seen in FIG. 2. Thus, a takeup coil 20 can be mounted on the support shaft 12 and a web 22 may be threaded from processing apparatus (not shown) over the upper web support roll 16 to the coil 20. The clockwise rotation of the coil 20 will draw the web 22 downstream (from the left to right as seen in the drawings). During this process, there will be a lap line 24 at the juncture between the incoming portion 26 of the web and the previously coiled portions of the web. The incoming portion 26 of the web and the outermost turn of the coil 20 will cooperatively define a wedge shaped space 28 (FIG. 2) on the coil side of the web immediately upstream from the lap line 24.

A carrier 30 is mounted on a shaft 32 which in turn is pivotally mounted to the frame 10. As seen in FIG. 1, the carrier 30 includes a cross member 34 and a pair of tines 36 which extend perpendicularly from the cross member 34. The tip of each tine remote from the cross member 34 has a downwardly facing marker engaging surface 38. The marker engaging surfaces of the tines are coplanar with one another. The carrier 30 is disposed on the coil side of the incoming portion 26 of the web (beneath the incoming portion 26) so that, as seen in FIG. 2, the marker engaging surfaces of the carrier face away from the incoming portion 26.

A double acting fluid operated cylinder 40 is linked to the carrier 30 and to the frame 10. The cylinder 40 is connected to a source of fluid under pressure 42 by means of a selectively operable bidirectional control valve 44. Thus, the cylinder 40 may be selectively actuated to swing the carrier 30 from its first position depicted in broken lines in FIG. 1 to its second position depicted in solid lines in FIGS. 1 and 2. As seen in FIG. 2, the shaft 32 on which the carrier 30 pivots extends obliquely of the plane defined by the incoming portion 26 of the web. When the carrier 30 pivots about the axis of shaft 32, the carrier will move in a plane perpendicular to the shaft 32, this plane being oblique to the plane of the incoming portion 26.

When the carrier 30 is in its first position depicted in broken lines in FIG. 1, the marker engaging surfaces 38 of the carrier will be laterally remote from the web 22. A flat tape like marker 46 having an adhesive face 48 may be releasably engaged with the carrier by applying portions of the adhesive surface to the marker engaging surfaces 38 of the carrier. Since the marker engaging surfaces of the carrier face downwardly or away from the web 22, the adhesive face 48 of the marker will face upwardly or towards the web. The marker 46 will extend between the two marker engaging surfaces 38 of the carrier, but portions of the marker will project from the carrier so that a first edge 50 of the marker 46 is remote from the carrier.

As the point along the length of the web 22 where the marker is to be applied approaches the coil 20, the control valve 44 is operated to actuate the cylinder 40 so as to swing the carrier 30 to its second position, depicted in solid lines in FIGS. 1 and 2. As the carrier moves towards its second position, the marker engaging surfaces 38 of the carrier and hence the marker 46 are moved into lateral alignment with the web 22. The marker engaging surfaces 38 and the marker 46 will pass between the rollers 16 and 18. Although the marker engaging surfaces of the carrier and hence the marker will move transversely of the web when the carrier first begins to pivot, the marker engaging surfaces of the carrier and hence the marker will move downstream or codirectionally with the web into the space 28 (FIG. 2) as the carrier approaches the second position.

Because the carrier pivots in a plane oblique to the plane of the incoming portion 26, the pivoting motion of the carrier will move the marker engaging surfaces 38 and the marker 46 toward the plane of the incoming portion (upwardly as seen in FIG. 2). The upwardly facing adhesive surface 48 of the marker 46 will confront the lower or coil facing surface of the incoming portion 26 of the web. Portions of the adhesive surface 48 adjacent to the projecting edge 50 of the marker will engage the confronting surface of web.

The marker will then be pulled away from the carrier by the movement of the web, and will be carried downstream past the lap line 24 to the position indicated at 46' in FIG. 2; the portion of the web which was the incoming portion when the marker was fed into engagement with the web will be carried downstream and will become the outermost turn of the coil 20. Thus, the marker 46 will be emplaced within the coil immediately after its engagement with the web. Of course, as additional portions of the web are subsequently wound onto the coil by its continued rotation, additional turns will be formed outwardly of the marker, thus further securing the marker in position.

The time at which the carrier is swung to its second position to feed the marker into engagement with the web is selected so that the marker will arrive at the point of engagement between the marker and the web as the selected point on the length of the web arrives at such location. This may be done by actuating the control valve 44 when the selected point on the length of the web passes some predetermined point on the web path upstream of the point of engagement. If the motor 14 is operated so as to advance the web at a constant speed, the time for the selected point on the web to move from such preselected upstream point to the point of engagement will be constant, and the arrival of such preselected point on the web and the marker at the point of engagement can be precisely synchronized to place the marker precisely at the preselected point on the web.

The location of the marker along the length of the web may also be selected by actuating the control valve at a predetermined time after the motor is started.

As numerous variations and combinations of the features described above can be utilized without departing from the spirit of the present invention as described in the claims. The foregoing description of the preferred embodiment should be taken by way of illustration rather than by way of limitation of the present invention.

What is claimed is:

1. Apparatus for marking a web comprising:

(a) takeup means for supporting a takeup coil and rotating it on a fixed axis to draw a web longitudinally onto the coil along a predetermined path; and (b) selectively operable marker dispensing means for feeding a flat adhesive marker into the space between the incoming portion of the web and the coil, said marker dispensing means including:

a rotable shaft disposed at an oblique angle relative to the plane of the surface of the incoming web;

a cross member secured to said shaft having a plurality of tines mounted thereto, said tines having marker engaging surfaces thereon for engagement with the adhesive side of the marker; and, means for rotating said shaft from a position whereat said marker engaging surfaces are alongside the web for securing a marker to said tines, to a position whereat said marker engages the surface of the web for placement of the marker on the web, the oblique placement of said shaft causing said tines to move in a bi-directional path relative to the surface of the web such that as the marker approaches the web, it is moving toward the web and in the same direction as web movement.

2. Apparatus as claimed in claim 1 wherein said marker dispensing means is arranged to feed the marker so that the marker will engage the incoming portion of the web before it engages the previously coiled portion.

3. Apparatus as claimed in claim 2 wherein said marker dispensing means includes means for holding a marker having an adhesive face while such marker is being fed so that the adhesive face of the marker will confront the coil facing surface of the incoming portion of the web.

4. Apparatus as claimed in claim 3 wherein said marker dispensing means is disposed on the coil side of the incoming portion of the web, said tines having marker engaging surfaces facing away from the incoming portion of the web, so that when a marker having an adhesive face is engaged with the marker dispensing means by applying a portion of such face to the marker engaging surface of said tines, the adhesive face of the marker will face toward the incoming portion of the web.

* * * * *